US009365804B2

(12) United States Patent
Park et al.

(10) Patent No.: US 9,365,804 B2
(45) Date of Patent: Jun. 14, 2016

(54) VEHICLE-GLASS CLEANING FLUID COMPOSITION COMPRISING ANIONIC SURFACTANT AND TARTARIC ACID

(75) Inventors: Jae Yoon Park, Seoul (KR); Chang Yeol Jo, Busan (KR); Hong Ki Lee, Gyeonggi-do (KR)

(73) Assignee: KUKDONG JEYEN COMPANY LIMITED, Gyeonggi-do (KR)

( * ) Notice: Subject to any disclaimer, the term of this patent is extended or adjusted under 35 U.S.C. 154(b) by 0 days.

(21) Appl. No.: 14/360,606

(22) PCT Filed: Jan. 31, 2012

(86) PCT No.: PCT/KR2012/000759

§ 371 (c)(1), (2), (4) Date: May 23, 2014

(87) PCT Pub. No.: WO2013/077497

PCT Pub. Date: May 30, 2013

(65) Prior Publication Data

US 2014/0303058 A1 Oct. 9, 2014

(30) Foreign Application Priority Data

Nov. 23, 2011 (KR) ..... 10-2011-0122596

(51) Int. Cl.

| | |
|---|---|
| ***C11D 3/00*** | (2006.01) |
| ***C11D 1/02*** | (2006.01) |
| ***C11D 3/20*** | (2006.01) |
| ***C11D 11/00*** | (2006.01) |
| ***C23F 11/08*** | (2006.01) |
| ***C23F 11/10*** | (2006.01) |

(52) U.S. Cl.

CPC ..... *C11D 3/0073* (2013.01); *C11D 1/02* (2013.01); *C11D 3/2003* (2013.01); *C11D 3/2086* (2013.01); *C11D 11/0035* (2013.01); *C23F 11/08* (2013.01); *C23F 11/10* (2013.01)

(58) Field of Classification Search

CPC ..... C11D 11/0035; C11D 3/2086

See application file for complete search history.

(56) References Cited

U.S. PATENT DOCUMENTS

| | | | | |
|---|---|---|---|---|
| 3,993,575 | A * | 11/1976 | Howanitz et al. | 510/434 |
| 7,531,490 | B2 * | 5/2009 | Kondo et al. | 510/164 |
| 7,998,919 | B2 * | 8/2011 | Rong et al. | 510/466 |
| 2002/0128169 | A1 * | 9/2002 | Levitt et al. | 510/428 |
| 2005/0245411 | A1 * | 11/2005 | Yang et al. | 510/184 |
| 2005/0245422 | A1 * | 11/2005 | Yamada et al. | 510/417 |
| 2006/0079437 | A1 * | 4/2006 | Kondo et al. | 510/505 |
| 2006/0276371 | A1 * | 12/2006 | Schreiner et al. | 510/475 |
| 2007/0235061 | A1 * | 10/2007 | Mizuta et al. | 134/2 |
| 2010/0056415 | A1 * | 3/2010 | Rong et al. | 510/238 |
| 2012/0138089 | A1 * | 6/2012 | Uhl et al. | 134/6 |

FOREIGN PATENT DOCUMENTS

| | | | |
|---|---|---|---|
| KR | 10-2001-0084055 | A | 9/2001 |
| KR | 10-2005-0045447 | A | 5/2005 |
| KR | 10-2005-0075064 | A | 7/2005 |
| KR | 10-2006-0051950 | A | 5/2006 |
| KR | 10-2007-0109000 | A | 11/2007 |

OTHER PUBLICATIONS

International Search Report for PCT/KR2012/000759, Oct. 15, 2012.

* cited by examiner

*Primary Examiner* — Gregory Webb

(74) *Attorney, Agent, or Firm* — Vorys, Sater, Seymour & Pease LLP; Mih Suhn Koh

(57) ABSTRACT

The present invention relates to a vehicle-glass cleaning fluid composition comprising an alcohol, an anionic surfactant, and tartaric acid as a corrosion inhibitor. The present invention provides a cleaning fluid composition entailing improved metal corrosion prevention, durability for rubbers and plastics, and performance in preventing the noise and wear which occur when there is friction between a wiper blade and glass surface. The cleaning fluid composition of the present invention has outstanding corrosion-preventing properties while also substantially improving test-piece weight-change reduction and abnormal appearance changes, and has a highly outstanding performance in preventing noise and wear due to friction.

4 Claims, No Drawings

VEHICLE-GLASS CLEANING FLUID COMPOSITION COMPRISING ANIONIC SURFACTANT AND TARTARIC ACID

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/KR2012/000759, filed Jan. 31, 2012, which claims priority to Korean Patent Application No. 10-2011-0122596, filed Nov. 23, 2011, entire contents of which are incorporated herein by reference.

TECHNICAL FIELD

The present invention relates to a vehicle-glass cleaning fluid composition.

BACKGROUND ART

The present invention relates to a vehicle-glass cleaning fluid composition, and more particularly, to a vehicle-glass cleaning fluid composition including alcohol, a surfactant, and a corrosion inhibitor. More specifically, the present invention relates to a vehicle-glass cleaning fluid composition capable of improving metal corrosion inhibition, durability for rubbers and plastics, and reduction in the frictional noise of wiper blades and wear resistance of the wiper blades, by including alcohol, an anionic surfactant as a surfactant, tartaric acid as a corrosion inhibitor, and an amine, azole, or nitric acid compound as an additional corrosion inhibitor.

Generally, a vehicle is provided with a wiper device and a spray device. In order to remove an obstruction in the driver's field of vision to secure a clear view, the wiper device closely adhering on the glass is swung in left and right directions to remove contaminants, such as water drops generated from rain or snow or other various kinds of foreign materials. In order to effectively clean the glass, the spray device sprays the vehicle-glass cleaning fluid composition. In the wiper device, the rubber section of a wiper blade brought into contact with a surface of the glass wipes the glass while being moved in left and right directions by a motor driving a wiper arm. However, the glass is a dense structure of non-crystallized solids that has only light transmissivity but not air permeability or absorptivity. A portion of the surface of the glass often comes away unlike the inside of the glass, causing repetitive corrosion or fine crack. Thus, dust particles, fumes, fat and oils, and the like in the air easily adhere on, diffuse in, and infiltrate a surface layer of the glass, and a thick contamination film that is difficult to remove is formed on the surface of the glass. The thick contamination forms another film or refracts light while driving during the rains or at night, resulting in the degradation of the driver's field of vision, causing accidents. Therefore, a cleaning fluid is used to secure a safe field of vision for the driver. This cleaning fluid requires several components associated with its chemical and physical properties while the respective components play different roles. Alcohol has an effect in cleaning, preventing freezing, and removing organic materials adhering on the vehicle-glass. A surfactant cleans the glass surface by removing contaminants and preventing re-adhering of the contaminants on the glass surface, preventing noise by reducing the frictional force when the wiper blade generates friction with the glass surface, and serves as a lubricant for smooth movement of the wiper blade. A corrosion inhibitor that prevents the corrosion of various kinds of metals and a spray nozzle of the spray device to impart durability to them may be added for other additives. Further, a predetermined amount of water is needed for adjustment of concentration.

However, the conventional vehicle-glass cleaning fluid had a problem in that since precipitation is generated by the aforementioned additives to clog the spray nozzle, contaminate a coating surface, and damage adjacent parts such as a wiper blade, and the residue remains on the vehicle-glass after evaporation of the sprayed cleaning fluid, obstructing the driver's field of vision and causing noise during operation of the wiper blade and wear of the wiper blade. However, these problems can be solved by a surfactant and a corrosion inhibitor, thereby preventing corrosion caused by the cleaning fluid and noise and wear caused by friction created by the wiper blade.

DETAILED DESCRIPTION OF THE INVENTION

Technical Problem

Therefore, the present inventors have endeavored to solve the above-mentioned problems. As a result, the present inventors have verified that, a novel vehicle-glass cleaning fluid composition including an anionic surfactant and tartaric acid in addition to the conventional vehicle-glass cleaning fluid composition can improve the metal corrosion inhibition, the durability for rubbers and plastics, reduction in the frictional noise of a wiper blade occurring due to the friction with the wiper blade, and the wear resistance of the wiper blade, and thus have completed the present invention.

Accordingly, an aspect of the present invention is to provide a vehicle-glass cleaning fluid composition.

Other purposes and advantages of the present invention will be clarified by the following detailed description of invention, claims, and drawings.

Technical Solution

In accordance with an aspect of the present invention, there is provided a vehicle-glass cleaning fluid composition including: (a) alcohol; (b) an anionic surfactant; and (c) tartaric acid as a metal inhibitor.

The present inventors have endeavored to solve the above-mentioned problems. As a result, the present inventors have verified that, a novel vehicle-glass cleaning fluid composition including an anionic surfactant and tartaric acid in addition to the conventional vehicle-glass cleaning fluid composition can improve the metal corrosion inhibition, the durability for rubbers and plastics, reduction in the frictional noise of a wiper blade occurring due to the friction with the wiper blade, and the wear resistance of the wiper blade, and thus have completed the present invention.

As used herein, the term "cleaning fluid" refers to a non-petroleum-based liquid for cleansing the entire glass surface of a vehicle used in a car (transporting vehicle), and a liquid material used to secure a safe field of vision of the driver during driving.

In the composition of the present invention, the cleaning fluid includes alcohol. In the composition of the present invention, any alcohol known in the art may be used. The alcohol is preferably selected from the group consisting of lower alcohol with 6 or fewer carbon atoms, higher alcohol with 6 or more carbon atoms, polyhydric alcohol, and an isomer thereof. More preferably, alcohol suitable for the composition of the present invention is methanol, ethanol, pentanol, 2-pentanol, isopentyl alcohol, 2-methyl-2-butanol, 3-methyl-2-butanol, propanol, 2-propanol, butanol, isobutyl alcohol, 2-butanol, 2-methyl-2-propanol, hexanol, cyclohexanol, benzyl alcohol, propyl alcohol, ethylene glycol, propylene glycol, diethylene glycol, glycerin or dipropylene glycol, and still more preferably lower alcohol with 1-3 carbon atoms, and most preferably methanol.

The alcohol content is preferably 20-90 wt %, more preferably 30-80 wt %, and still more preferably 30-70 wt %, based on the total weight of the composition.

In the composition of the present invention, the cleaning fluid includes a surfactant. In the composition of the present invention, any surfactant known in the art may be used. The surfactant is preferably selected from the group consisting of an anionic, cationic, non-ionic, or amphoteric surfactant, more preferably an anionic surfactant, such as a sulfate anionic surfactant, a sulfonate anionic surfactant, a phosphate anionic surfactant, or a carboxylate anionic surfactant. More preferably, the surfactant is a sulfonate anionic surfactant, which is selected from sodium dioctyl sulfosuccinate, sodium di-2-ethylhexyl sulfosuccinate, sodium lauryl sulfate, potassium lauryl sulfate, dodecyl benzene sulfate, alpha-olefin sulfonate, lignosulfonate, perfluorooctane sulfonate (PFOS), perfluoro butane sulfonate, or alkyl benzene sulfonate or sulfo-carboxylate compound. Most preferably, the surfactant is sodium dioctyl sulfosuccinate, sodium lauryl sulfate, perfluorooctane sulfonate (PFOS), perfluoro butane sulfonate, or alkyl benzene sulfonate.

In the composition of the present invention, the content of the anionic surfactant as the surfactant is preferably 0.05-5.0 wt %, more preferably 0.01-3.0 wt %, and still more preferably 0.01-1.0 wt %, based on the total weight of the composition.

In the composition of the present invention, the cleaning fluid includes a corrosion inhibitor. In the composition of the present invention, any corrosion inhibitor known in the art may be used. The corrosion inhibitor used in the present invention is tartaric acid.

The content of tartaric acid as the corrosion inhibitor is preferably 0.01-5.0 wt %, more preferably 0.01-3.0 wt %, and still more preferably 0.05-1.0 wt %, based on the total weight of the composition.

According to a preferable embodiment of the present invention, the vehicle-glass cleaning fluid composition of the present invention further includes amine, azole, a nitric compound, or a mixture thereof, as a corrosion inhibitor. As the mixture thereof, one or one or more corrosion inhibitors selected from the group consisting thereof.

Amine usable in the present invention includes various amines known in the art. The amine is preferably selected from methylamine, monomethylamine, dimethylamine, trimethylamine, ethylamine, monoethylamine, diethylamine, triethylamine, ethanolamine, monoethanolamine, diethanolamine, triethanolamine, n-propanolamine, isopropanolamine, diisopropanolamine, triisopropanolamine, butylamine, 1-ethyl-butylamine, 1,3-diaminopropane, di-n-propylamine, di-n-butylamine, 4,4'-diamino-diphenylamine, dimethylethylamine, diethylmethylamine, triethylamine, tributylamine, ethylenediamine, triethylenetetraamine, tetraethylenepentaamine, methyldiethanolamine, diethylenetriamine, hydroxylamine, alkyldiethanolamine, cyclohexylamine, morpholine, phenylmorpholine, di-(2-ethylhexyl)amine, di-N-butylamine, monoamylamine, diamylamine, dioctylamine, salicylmonoethanolamine, di-beta-naphthyl-p-phenylenediamine, benzylamine, or 1,3-propanediamine. Most preferably, the amine is selected from methyldiethanolamine, diethylenetriamine, hydroxylamine, cyclohexylamine, monoethanolamine, or triethanolamine. These amines may be used alone or in a mixture of two or more thereof.

The content of amine as the additional corrosion inhibitor is preferably 0.01-5.0 wt %, more preferably 0.01-3.0 wt %, and still more preferably 0.05-1.0 wt %, based on the total weight of the composition.

The azole usable in the present invention includes various azoles known in the art. The azole is preferably selected from benzotriazole, tolyltriazole, octyltriazole, decyltriazole, dodecyltriazole, aminotriazole, aminotetrazole, methylbenzotriazole, mercaptobenzotriazole, 3-aminotriazole, 4-aminotriazole, 2,5-diaminotriazole, 4-mercaptotriazole, 3-amino-5-mercaptotriazole, 2-mercaptothiazoline, 2-aminotriazole, 2,5-dimercapto-1,3,4-thiadiazole, 2-mercapto-5-hydrocarbylthio-1,3,4-thiadiazole, 2-mercapto-5-hydrocarbyldithio-1,3,4-thiadiazole, 2,5-bis(hydrocarbylthio)-1,3,4-thiadiazole, 2,5-(bis)hydrocarbyldithio-1,3,4-thiadiazole, or 5-chloro-3-methylthio-1,2,4-thiadiazole. Most preferably, the azole is benzotriazole, tolyltriazole, octyltriazole, decyltriazole, dodecyltriazole, methylbenzotriazole, mercaptobenzotriazole, or 2,5-dimercapto-1,3,4-thiadiazole.

The content of azole as the additional corrosion inhibitor is preferably 0.01-5.0 wt %, more preferably 0.01-3.0 wt %, and still more preferably 0.05-1.0 wt %, based on the total weight of the composition.

The nitric compound usable in the present invention includes various nitric compounds known in the art. The nitric compound is preferably selected from the group consisting of nitrate, nitrite, and a mixture thereto. More preferably, the nitric compound is selected from sodium nitrate, calcium nitrate, potassium nitrate, lithium nitrate, barium nitrate, magnesium nitrate, iron nitrate, bismuth nitrate, ammonium nitrate, copper nitrate, cobalt nitrate, zinc nitrate, manganese nitrate, molybdenum nitrate, cerium nitrate, sodium nitrite, calcium nitrite, potassium nitrite, lithium, barium nitrite, silver nitrite, or magnesium nitrite. Most preferably, the nitric compound is sodium nitrate, potassium nitrate, ammonium nitrate, calcium nitrite, potassium nitrite, barium nitrite, or sodium nitrite.

The content of the nitric compound as the additional corrosion inhibitor is preferably 0.01-5.0 wt %, more preferably 0.01-3.0 wt %, and still more preferably 0.05-1.0 wt %, based on the total weight of the composition.

In the composition of the present invention, the total content of the corrosion inhibitors is preferably 0.1-5.0 wt %, more preferably 0.1-3.0 wt %, and still more preferably 0.1-1.0 wt %, based on the total weight of the composition.

The vehicle-glass cleaning fluid composition of the present invention is completed as a cleaning fluid by using balance water as a dilution liquid.

The content of water is preferably 10-70 wt %, more preferably 10-50 wt %, and still more preferably 10-30 wt %, based on the total weight of the composition.

In the vehicle-glass cleaning fluid composition of the present invention including alcohol, an anionic surfactant, and tartaric acid as a corrosion inhibitor, preferable contents thereof are 30-70 wt % for the alcohol, 0.01-1.0 wt % for the surfactant, 0.1-1.0 wt % for the corrosion inhibitor, and 10-50 wt % for the water.

The vehicle-glass cleaning fluid of the present invention is excellent in long-term metal corrosion inhibition for metal materials and durability for rubbers and plastics. In addition, the vehicle-glass cleaning fluid of the present invention can solve the problems such as noise and wear occurring during the friction between the wiper blade and the glass surface.

Advantageous Effects

Features and advantages of the present invention are summarized as follows:

(a) The cleaning fluid composition of the present invention is characterized by including alcohol, an anionic surfactant, and tartaric acid as a corrosion inhibitor.

(b) The present invention provides a cleaning fluid composition having enhanced capacity to inhibit metal corrosion.

(c) The present invention provides a cleaning fluid composition which improves durability for rubbers and plastics.

(d) The present invention provides a cleaning fluid composition having improved capability to prevent noise and wear occurring during the friction between the wiper blade and the glass surface.

(e) The cleaning fluid composition of the present invention has great improvement in reduction in weight change of a specimen and change in external appearance while having improving corrosion inhibition, and is very excellent in noise and wear prevention caused by friction.

Mode for Carrying Out the Invention

Hereinafter, the present invention will be described in detail with reference to examples. These examples are only for illustrating the present invention more specifically, and it will be apparent to those skilled in the art that the scope of the present invention is not limited by these examples.

EXAMPLES

Preparative Example

The vehicle-glass cleaning fluid compositions were prepared according to compositions of Table 1 below.

TABLE 1

| Function | Composition (wt %) | Example 1 | Example 2 | Example 3 | Example 4 | Comparative Example 1 | Comparative Example 2 |
|---|---|---|---|---|---|---|---|
| Alcohol | Methanol | 50 | 50 | 50 | 50 | 50 | 50 |
| | Ethanol | — | — | — | — | — | — |
| | Isopropyl alcohol | — | — | — | — | — | — |
| Water | Purified water | Balcance | Balcance | Balcance | Balcance | Balcance | Balcance |
| Metal corrosion inhibitor | Tartaric acid | 0.05 | 0.1 | 0.2 | 0.5 | — | — |
| | tolyltriazole | 0.1 | — | — | 0.1 | 0.2 | 0.5 |
| | Phosphate | — | — | — | — | 0.2 | 0.1 |
| | Sodium nitrite | 0.1 | — | 0.1 | — | — | — |
| | Triethanol amine | 0.1 | — | 0.1 | — | 0.1 | — |
| | Monoethanol amine | — | 0.1 | — | 0.1 | — | 0.1 |
| Surfactant | Sodium dioctyl sulfosuccinate (anion) | 0.1 | — | 0.1 | — | — | — |
| | Sodium lauryl sulfate (anion) | — | 0.1 | — | 0.1 | — | — |
| | Lauryl benzyl ammonium chloride (cationic) | — | — | — | — | 0.1 | — |
| | Lauryl amine oxide (non-ionic) | — | — | — | — | — | 0.1 |

Respective vehicle-glass cleaning fluid compositions of examples and comparative examples were prepared according to the compositions shown in Table 1. Here, respective components for each composition were stirred and mixed at room temperature (25° C.) for 1 hour, and then filtered by microfiltration (10 μm).

Test Examples

The performance of the vehicle-glass cleaning fluids of the examples and comparative examples (Table 1) was evaluated by conducting tests on metal corrosion, effect on coating film, effect on rubber, effect on plastic, cleaning of the wiper blade, and noise generation, and the test results were shown in Tables 2 to 4.

TABLE 2

| Test on long-term metal corrosion for respective compositions (50° C. × 120 hr) | | | | | | | | |
|---|---|---|---|---|---|---|---|---|
| Classification | | | | | | | Comparative | Comparative |
| Item | Standard | | Example 1 | Example 2 | Example 3 | Example 4 | Example 1 | Example 2 |
| Test on long-term metal corrosion ($mg/cm^2$) | Aluminum | ±1.30 | 0.03 | 0.04 | 0.04 | 0.04 | −0.7 (Corrosion) | −1.1 (Corrosion) |
| | Brass | ±0.15 | 0.05 | 0.05 | 0.05 | 0.06 | 0.2 | 0.3 |
| | Zinc-plated plate | ±0.80 | 0.05 | 0.04 | 0.05 | 0.06 | −1.1 (Corrosion) | −1.5 (Corrosion) |

In order to evaluate the excellence of the vehicle-glass cleaning fluid with respect to the long-term durability, the following test was conducted. The test on metal corrosion was conducted according to the standard KS M 2163, and the results at 50° C. after 120 hours were observed.

As a result of the test on long-term metal corrosion, as can be seen from Table 2, the vehicle-glass cleaning fluids containing an anionic surfactant and tartaric acid according to the examples were 23 times superior to the comparative examples (that is, vehicle-glass cleaning fluids not containing an anionic surfactant and tartaric acid) in terms of the change in metal weight. In addition, the vehicle-glass cleaning fluids containing an anionic surfactant and tartaric acid did not cause corrosion on aluminum and the zinc-plated plate. However, corrosion occurred on aluminum and the zinc-plated plate for the comparative examples (that is, vehicle-glass cleaning fluids not containing an anionic surfactant and tartaric acid). Thus, it can be verified that the anionic surfactant with tartaric acid of the present invention enhanced the capacity to inhibit metal corrosion.

TABLE 3

| Effect on coating film, rubber, and plastic for respective compositions | | | | | | | | |
|---|---|---|---|---|---|---|---|---|
| Classification | | | | | | | Comparative | Comparative |
| Item | Standard | | Example 1 | Example 2 | Example 3 | Example 4 | Example 1 | Example 2 |
| Effect on coating film 50° C. × 60 hr | Appearance | Should not be abnormal | No abbormality | No abnormality | No abnormality | No abnormality | Spots | Spots |
| Effect on rubber 50° C. × 120 hr | Natural rubber | ±0.15 | 0.10 | 0.09 | 0.11 | 0.11 | 0.14 | 0.16 |
| | Chloroprene rubber | ±0.20 | 0.12 | 0.11 | 0.11 | 0.12 | 0.31 | 0.45 |
| | Appearance | Should not be abnormal | No abbormality | No abnormality | No abnormality | No abnormality | Fine cracks | Fine cracks |
| Effect o plastic 50° C. × 120 hr | Polyethylen resin | ±1.0 | 0.15 | 0.11 | 0.14 | 0.15 | 0.78 | 0.88 |
| | Polypropylene resin | ±1.0 | 0.11 | 0.20 | 0.15 | 0.16 | 0.85 | 0.85 |
| | ABS resin | ±4.0 | 1.25 | 1.18 | 1.34 | 1.38 | 3.51 | 3.72 |
| | Soft vinyl chloride resin | ±3.0 | 0.88 | 0.95 | 0.89 | 0.96 | 2.55 | 2.69 |
| | Polyacetal resin | ±3.0 | 0.95 | 1.01 | 0.98 | 0.98 | 3.41 | 3.68 |
| | Appearance | Should not be abnormal | No abbormality | No abnormality | No abnormality | No abnormality | Fine cracks | Fine cracks |

In order to evaluate the excellence of the vehicle-glass cleaning fluid with respect to the durability, the following tests for detailed items were conducted. According to the standard KS M 2163, the tests were conducted for the following items: a) effect on coating film, b) effect on rubber, and c) effect on plastic. As can be seen from Table 3, the evaluation methods and results for the detailed items with respect to the durability were as follows: a) When a vehicle-glass cleaning fluid was sprayed, it was put on a vehicle body coating film of a vehicle in addition to a vehicle glass. During the drying procedure of the vehicle-glass cleaning fluid put on the vehicle body coating film, the spots on the coating film and the swelling of the coating film were observed at 50° C. for 60 hours, thereby evaluating the effect on the coating film. As a result, the vehicle-glass cleaning fluids containing an anionic surfactant and tartaric acid did not cause spots, but the comparative examples (vehicle-glass cleaning fluids not containing an anionic surfactant and tartaric acid) caused spots. b) A rubber of the wiper blade was brought into contact with the glass, and it was swung to wipe out impurities. Here, the weight change and appearance change of the rubber due to the contact were observed at 50° C. for 120 hours, thereby evaluating the effect on the rubber. As a result, the vehicle-glass cleaning fluids containing an anionic surfactant and tartaric acid was superior to the comparative examples (that is, vehicle-glass cleaning fluids not containing an anionic surfactant and tartaric acid) in terms of the weight change of rubber. In addition, the appearance of rubber was excellently maintained without being changed by the vehicle-glass cleaning fluids containing an anionic surfactant and tartaric acid, but fine cracks occurred on the appearance for the comparative examples (that is, vehicle-glass cleaning fluids not containing an anionic surfactant and tartaric acid). c) When a vehicle-glass cleaning fluid was sprayed, it was put on a plastic material of a vehicle. Here, the weight change and appearance change of the plastic due to the contact were observed at 50° C. for 120 hours, thereby evaluating the effect on the plastic. As a result, the vehicle-glass cleaning fluids containing an anionic surfactant and tartaric acid were superior to the comparative examples (that is, vehicle-glass cleaning fluids not containing an anionic surfactant and tartaric acid) in terms of the weight change of plastic. In addition, the appearance of plastic was excellently maintained without being changed by the vehicle-glass cleaning fluids containing an anionic surfactant and tartaric acid, but fine cracks occurred on the appearance of the plastic for the comparative examples (that is, vehicle-glass cleaning fluids not containing an anionic surfactant and tartaric acid). Thus, it can be verified that the anionic surfactant with tartaric acid of the present invention enhanced the durability.

TABLE 4

Test on cleaning ability, noise generation, and blade wear for respective composition.

| Classification | | | | | | Comparative | Comparative |
|---|---|---|---|---|---|---|---|
| Item | Standard | Example 1 | Example 2 | Example 3 | Example 4 | Example 1 | Example 2 |
| Cleaning ability | Should have equivalent to or higher than conspicuity | No abbormality | No abnormality | No abnormality | No abnormality | No abbormality | No abnormality |
| Noise generation | Should have no noise | No abbormality | No abnormality | No abnormality | No abnormality | Two times of noise generation | Three times of noise generation |
| Blade wear | Should have no wear | No abbormality | No abnormality | No abnormality | No abnormality | Weaer | Wear |

In order to evaluate the excellence of the vehicle-glass cleaning fluid for the wiper blade, the following tests for detailed items were conducted. According to the standard KS M 2163, the tests were conducted for the following items: a) cleaning ability, b) noise generation, and c) wear state. As can be seen from Table 4, the evaluation results for the detailed items were as follows: a) The vehicle-glass cleaning fluid was sprayed on the glass of a vehicle, and then the conspicuity therefrom was compared with that of the control fluid. As a result, the vehicle-glass cleaning fluids containing an anionic surfactant and tartaric acid and the comparative examples (that is, vehicle-glass cleaning fluids not containing an anionic surfactant and tartaric acid) showed equivalent levels of result values without abnormality. It is determined that the conspicuity is not significantly influenced by the kind of additives in the composition of the present invention. b) The vehicle-glass cleaning fluid was sprayed after the glass of the vehicle was cleanly wiped and dried, and then the wiper blade was operated. The noise generated here was observed. The aforementioned procedure was executed a total of five times with 20 times per each execution. As a result, the vehicle-glass cleaning fluids containing an anionic surfactant and tartaric acid did not cause noise, but the comparative examples (vehicle-glass cleaning fluids not containing an anionic surfactant and tartaric acid) caused noise two times and three times, respectively. c) The vehicle-glass cleaning fluid was sprayed after the glass of the vehicle was cleanly wiped and dried, and then the wiper blade was operated. Here, the wear generated here was observed. The aforementioned procedure was executed a total of five times with 20 times per each execution. As a result, the vehicle-glass cleaning fluids containing an anionic surfactant and tartaric acid did not cause wear, but the comparative examples (vehicle-glass cleaning fluids not containing an anionic surfactant and tartaric acid) caused wear. Thus, it can be verified that the surfactant containing an anionic surfactant and tartaric acid of the present invention improved the cleaning ability, the noise generation, and the wear resistance, with respect to the wiper blade.

The invention claimed is:

1. A vehicle-glass cleaning fluid composition comprising:

(a) 30-70 wt % of $C_1$-$C_3$ alcohol based on the total weight of the composition;

(b) 0.01-1.0 wt % of sulfonate anionic surfactant based on the total weight of the composition;

(c) 0.05-1.0 wt % of tartaric acid as a metal inhibitor based on the total weight of the composition; and (d) amine, azole, and a nitric compound as the metal corrosion inhibitor, wherein the amine is methyldiethanolamine, diethylenetriamine, hydroxylamine, cyclohexylamine, monoethanolamine, or triethanolamine;

the azole is benzotriazole, tolyltriazole, octyltriazole, decyltriazole, dodecyltriazole, methylbenzotriazole, mercaptobenzotriazole, or 2,5-dimercapto-1,3,4-thiadiazole;

and the nitric compound is sodium nitrate, potassium nitrate, ammonium nitrate, potassium nitrite, barium nitrite, or sodium nitrite, and wherein the composition does not include phosphonic acids and calcium salt.

2. The vehicle-glass cleaning fluid composition of claim 1, wherein the sulfonate anionic surfactant is sodium dioctyl sulfosuccinate, perfluorooctane sulfonate (PFOS), perfluoro butane sulfonate, or alkyl benzene sulfonate.

3. A method for cleaning a vehicle-glass, comprising: applying to the vehicle-glass a composition comprising (a) 30-70 wt % of $C_1$-$C_3$ alcohol based on the total weight of the composition; (b) 0.01-1.0 wt % of sulfonate anionic surfactant based on the total weight of the composition; (c) 0.05-1.0 wt % of tartaric acid as a metal inhibitor based on the total weight of the composition; and (d) amine, azole, and a nitric compound as the metal corrosion inhibitor, wherein the amine is methyldiethanolamine, diethylenetriamine, hydroxylamine, cyclohexylamine, monoethanolamine, or triethanolamine; the azole is benzotriazole, tolyltriazole, octyltriazole, decyltriazole, dodecyltriazole, methylbenzotriazole, mercaptobenzotriazole, or 2,5-dimercapto-1,3,4-thiadiazole; and the nitric compound is sodium nitrate, potassium nitrate, ammonium nitrate, potassium nitrite, barium nitrite, or sodium nitrite, and wherein the composition does not include phosphonic acids and calcium salt.

4. The method of claim 3, wherein the sulfonate anionic surfactant is sodium dioctyl sulfosuccinate, perfluorooctane sulfonate (PFOS), perfluoro butane sulfonate, or alkyl benzene sulfonate.

* * * * *